US006200064B1

(12) United States Patent
Hedgewick

(10) Patent No.: US 6,200,064 B1
(45) **Date of Patent: *Mar. 13, 2001**

(54) ROAD MARKER WITH COLLAR

(75) Inventor: Peter H. Hedgewick, Windsor (CA)

(73) Assignee: Pac-Tec, Inc., Heath, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/948,948

(22) Filed: Oct. 10, 1997

Related U.S. Application Data

(60) Provisional application No. 60/028,302, filed on Oct. 11, 1996.

(51) Int. Cl.[7] ..... G01F 11/00

(52) U.S. Cl. ..... 404/13; 404/14; 404/15; 404/16

(58) Field of Search ..... 404/12, 14, 16, 404/9, 13, 15

(56) References Cited

U.S. PATENT DOCUMENTS 3,784,279 * 1/1974 Hedgewick ..... 404/12
4,035,059 * 7/1977 DeMaster ..... 350/105
4,557,624 12/1985 Walker .
4,577,992 * 3/1986 Jefferies ..... 404/16
4,618,281 10/1986 Ajemian .
4,717,281 1/1988 Shepherd et al. .
5,425,596 * 6/1995 Steere et al. ..... 404/14
5,681,128 * 10/1997 Morgan et al. ..... 404/12
5,857,802 * 1/1999 Richter ..... 404/14

FOREIGN PATENT DOCUMENTS

2401273 * 4/1979 (FR) ..... 404/15

* cited by examiner

*Primary Examiner*—Eileen D. Lillis
*Assistant Examiner*—Gary S. Hartmann
(74) *Attorney, Agent, or Firm*—Gifford, Krass, Groh, Sprinkle, Anderson & Citkowski, P.C.

(57) ABSTRACT

A road marker having a collar for mounting a reflector to the surface of the road. The collar is a generally flat disk, having a pair of diametrically opposed projections. The projections have inner planar surfaces to receive a reflector therebetween and curved outer surfaces to facilitate the passage of tires over the marker. The projections have a width and height greater than that of the reflector to protect the ends of the reflector from abrasion. A recess is provided for mounting the reflector to the collar. A plurality of shallow apertures are formed on the bottom surface for receiving a mounting compound for adhering the collar to the road surface.

5 Claims, 2 Drawing Sheets

ROAD MARKER WITH COLLAR

RELATED APPLICATIONS

This application takes priority from Provisional Application No. 60/028,302, filed Oct. 11, 1996.

I. Field of the Invention

This application relates to retro-reflective road markers for installation on pavement of a road.

II. Background of the Invention

Road markers having retro-reflective lenses are used on road surfaces to delineate lanes at night. The road markers reflect light from the headlights of an automobile at night to indicate where the lanes of a road are positioned. The markers typically have a trapezoidal cross-section with a rectangular bottom shape and have dimensions of approximately two inches by four inches and three-quarters of an inch high. The markers are mounted directly to the road with suitable materials such as bituminous or epoxy. However, in areas where the climate is hot and the road surface is formed of asphalt or the like, the road surface softens due to heat. In these conditions, the markers are frequently mashed into the pavement by trucks or heavy vehicles when the road surface softens. Additionally, the passage of the tires of the heavy vehicles over the reflectors frequently chips or damages the end corners of the markers. Accordingly, it would be desirable to produce a road marker in such a way that it can be easily installed without sinking into the road surface. Additionally, it would be desirable to provide protection for the ends of the reflectors.

SUMMARY OF THE INVENTION

The invention relates to a road marker having a collar for mounting a reflector to the surface of a road. The collar is in the form of a circular disk having a pair of diametrically opposed projections. The projections have a flat inner surface to receive a retro-reflector therebetween. The projections width and height are slightly greater than that of the road marker to protect the ends of the reflector from abrasion. Each projection has a rounded outer surface to facilitate the passing of tires over the marker. A recess may be provided for mounting the reflector to the collar. A series of shallow apertures are formed on the bottom surface for adherence of glue for mounting to the road surface.

BRIEF DESCRIPTION OF THE DRAWING

The present invention will be more fully understood by reference to the following detailed description, when read in conjunction with the accompanying drawings, in which like reference characters refer to like parts throughout the several views and in which.

DETAILED DESCRIPTION OF THE PREFERRED EMBODIMENT

Figure 1:
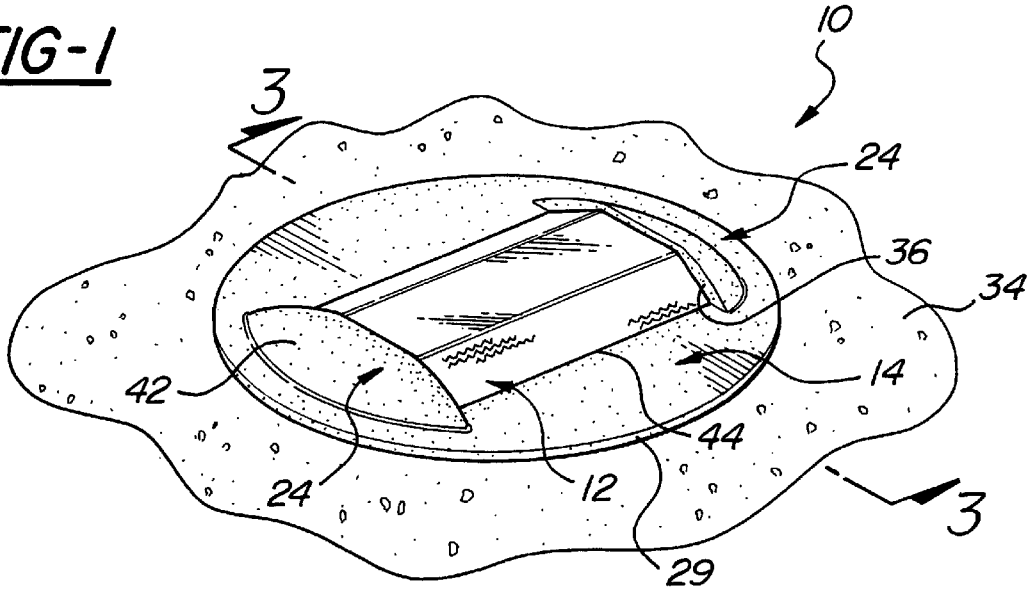
FIG. 1 is a perspective view of a road marker according to the invention mounted to a road surface.
Figure 2:
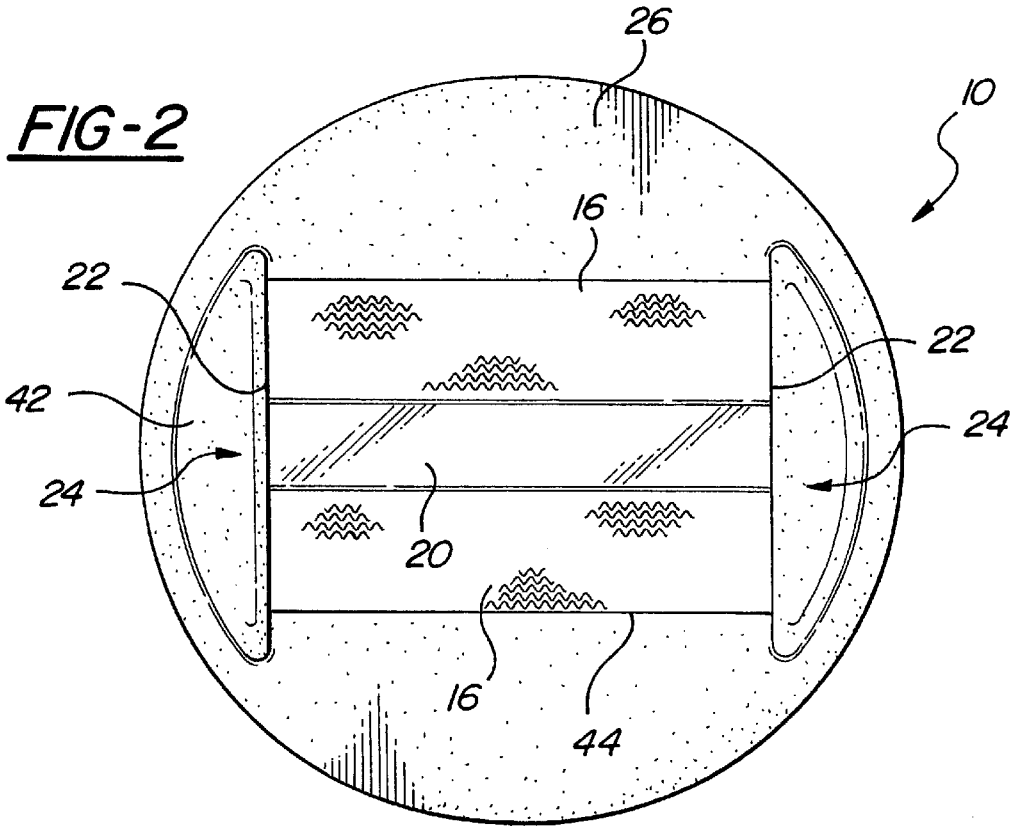
FIG. 2 is a top view of the road marker collar and showing a retro-reflector.
Figure 3:
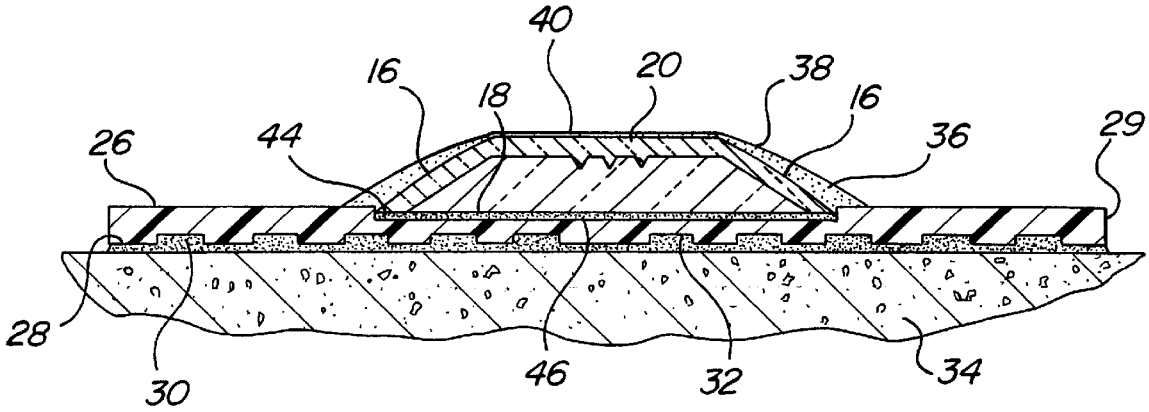
FIG. 3 is a cross-sectional center view of the marker taken along lines 3—3 of FIG. 1.

A road marker 10 having a conventional retro-reflector 12 supported on a collar 14 is shown in FIG. 1. As shown in FIGS. 1, 2 and 3, the reflector 12 is of a conventional type. The reflector 12 includes two angled retro-reflective faces

16, a bottom surface 18, and a top surface 20 which extend between a pair of trapezoidal shaped ends 22.

As shown in FIG. 1, the collar 14 or base member is disk-like, having a pair of diametrically opposed projections 24 extending from a top surface 26 of the collar 14.

The top surface 26 is spaced apart from a bottom surface 28 by an edge 29. The collar 14 is approximately ¼ inch think and has a diameter of 5½ inches.

Figure 4:
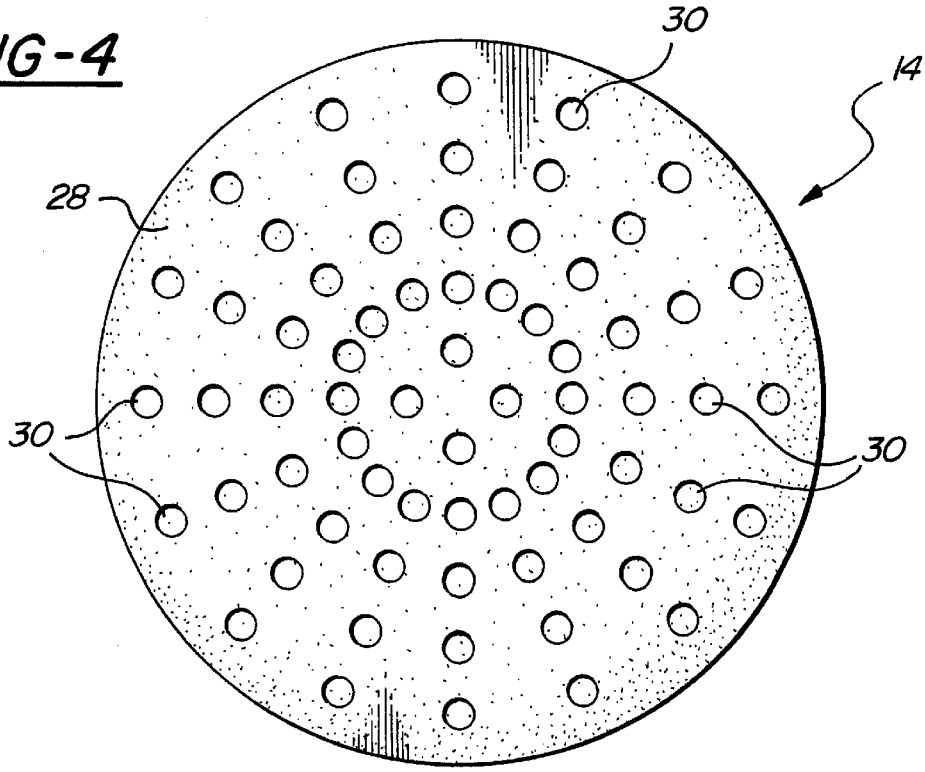
FIG. 4 is a bottom plan view of the collar.

As shown in FIGS. 3 and 4, the bottom surface 28 includes a plurality of circular perforations 30 formed in a plurality of radially extending lines. The perforations 30 are formed to receive glue 32 or epoxy for adherence to the road 34 as shown in FIG. 3. The marker is mounted by placing a quantity of glue on the road surface and forming the collar downwardly thereby forcing a quantity of glue outwardly from the edge 29.

As shown in FIGS. 1, 2 and 3, the projections have generally flat vertically extending walls 36. Each inner wall 36 extends to an edge 38 which curves from the top surface 26 upwardly to a flat center portion 40 which is slightly higher than the height of the reflector 12 and then curves back downwardly to the top surface 26. The wall 36 has a width greater than the reflector. A curved outer surface 42 extends from the edge 38 of the inner wall 36 radially outwardly and downwardly to the top surface 26. Thus, each projection 24 has the shape of a quarter sector of an elongated sphere. The projections 24 act to protect the ends and edges of the reflective surfaces 16 of the road reflector from abrasion and wear from the tire as it passes over the reflector 12. The projections 24 are contoured to facilitate a smooth passage of tires over the reflector. A rectangular recess 44 extends between the projections 24 to receive the bottom portion 18 of the reflector 12 therein. The reflector is mounted to the recess with an adhesive strip 46. The recess is approximately ⅛ inch deep.

In the preferred embodiment, the collar 14 is formed of a molded composite material, such as polyester, however, other durable materials such as fiberglass may be used. The road collar 14 thus disclosed provides additional surface area for mounting the road reflector to the road surface to prevent depression of the road reflector into the road surface when asphalt is softened by heat. Additionally, the projections protect the ends of the marker from damage.

Having described my invention, however, many modifications thereto may become apparent to those skilled in the art. While the collar has a circular shape, other shapes such as rectangular or hexagon, are contemplated. These and other changes are within the spirit of the invention as defined by the scope of the appended claims.

I claim:

1. An apparatus for mounting a reflector member to a surface of a road said reflector member having a housing having a pair of ends, a top surface and a bottom surface said housing having at least one reflector portion extending between said pair of ends above said bottom surface, said apparatus comprising:

a unitarily molded base member formed of a polymer, said base member having a bottom surface for mounting to the road surface, a generally flat upper surface, and a side surface extending therebetween, said side surface having a peripheral edge defining said bottom surface, said bottom surface extending continuously on a first plane between diametrically opposed portions of said peripheral edge, said upper surface spaced apart and parallel to said bottom surface, said base member having a pair of diametrically opposed projections extending upwardly outwardly from said upper surface, each of said pair of projections having a curved outer surface and an inner wall, said inner walls having an upper edge and a bottom edge, said outer wall extending from said upper edge to said upper surface of said base member, said base member having a mounting surface portion extending on a second plane generally coplanar with said first plane, said mounting surface portion extending diametrically across a center portion of said base member between said bottom edge of each of said pair of projections, said pair of projections adapted to receive said reflector member therebetween with said bottom of said reflector member mounted on said mounting surface, said inner wall having a width at said lower edge greater than a width of said reflector member.

2. The apparatus of claim 1, wherein said base member further comprises a recess formed in said top surface between said inner walls of said projections.

3. The apparatus of claim 1, wherein said pair of projections have a height greater than the height of said reflector.

4. The apparatus of claim 1, wherein said inner wall of said projections has a width greater than a width of said reflector.

5. The apparatus of claim 1, wherein said bottom surface has a plurality of circular indentations for receiving a mounting compound.

* * * * *